US006224010B1

(12) United States Patent
Morand

(10) Patent No.: US 6,224,010 B1
(45) Date of Patent: May 1, 2001

(54) APPARATUS AND METHOD FOR DISPENSING PAPER TOWELING FROM A ROLL OF PAPER TOWELING

(75) Inventor: Michel Morand, Montreal (CA)

(73) Assignee: Perrin Manufacturing Company, City of Industry, CA (US)

( * ) Notice: Subject to any disclaimer, the term of this patent is extended or adjusted under 35 U.S.C. 154(b) by 0 days.

(21) Appl. No.: 09/012,103

(22) Filed: Jan. 22, 1998

(51) Int. Cl.[7] ..... B65H 20/02; B65H 19/00

(52) U.S. Cl. ..... 242/564.4; 242/560.1; 242/560.3; 242/564.2; 242/566; 226/191; 226/196.1

(58) Field of Search ..... 242/566, 560, 242/560.1, 564.2, 564.4, 560.3; 312/34.19, 34.22; 226/168, 191, 196.1

(56) References Cited

U.S. PATENT DOCUMENTS 1,161,456 * 11/1915 Crowder ..... 242/564.2
1,860,668 * 5/1932 Gillet ..... 242/564.2
3,034,692 * 5/1962 Busch ..... 226/168
3,089,659 * 5/1963 Perrin ..... 242/564.4
3,294,460 * 12/1966 Wooster et al. ..... 312/34.19
3,853,256 * 12/1974 Shaffstall ..... 226/191
4,846,412 * 7/1989 Morand ..... 242/560.1
5,765,719 * 6/1998 Upham et al. ..... 242/560

* cited by examiner

*Primary Examiner*—John Q. Nguyen
(74) *Attorney, Agent, or Firm*—Thomas R. Lampe

(57) ABSTRACT

Dispenser apparatus for dispensing paper toweling from a roll of paper toweling includes a paper toweling feed roller and a guide partially surrounding the feed roller having a curved guide surface spaced from the paper toweling feed roller. The feed roller and the guide form a curved passageway through which paper toweling passes during transport from a roll of paper toweling to a location external of the dispenser housing. Automatic transfer to a full roll of paper toweling takes place upon depletion of another roll.

20 Claims, 5 Drawing Sheets

APPARATUS AND METHOD FOR DISPENSING PAPER TOWELING FROM A ROLL OF PAPER TOWELING

TECHNICAL FIELD

This invention relates to dispenser apparatus for dispensing paper toweling from a roll of paper toweling and also to a method of dispensing paper toweling from a roll of paper toweling.

BACKGROUND OF THE INVENTION

Many dispenser systems are known in the prior art for dispensing paper toweling from rolls thereof. In some cases the paper toweling is comprised of individual paper towel segments separated by perforated tear lines, and in others the toweling has no perforated tear lines formed therein, the user severing or cutting individual sheets from the toweling by some suitable means incorporated in the dispenser.

Some commonly employed paper dispensers provide for removal of the toweling from the roll as a result of a consumer manually grasping the lead end of the toweling and pulling it through an opening in the towel dispenser cabinet. Employing such an approach, tabbing or breaking of pieces from the end most towel segment can and does occur, particularly when a consumer's hands are wet when grasping the towel, as is often the case. Such arrangements may require use of special "high strength" toweling and expensive mechanism to operate properly.

It is also well known to employ drive mechanisms in paper towel dispenser cabinets associated with levers, knobs or the like which are actuated by a consumer (usually by manual contact) to advance the toweling. These latter arrangements conventionally incorporate one or more rollers forming a compressive nip through which the toweling passes during the dispensing operation.

It is also well known in the prior art to provide mechanical arrangements of various types in paper towel dispenser cabinets to effect transfer from one roll of toweling to another when a roll is at or near depletion. Such mechanisms are often characterized by their relative complexity and expense. Furthermore, some of the transfer systems are not as reliable or effective as one might wish. The more complex prior art transfer mechanisms can be prone to misalignment and even failure after time.

DISCLOSURE OF INVENTION

The present invention relates to dispenser apparatus for dispensing paper toweling from a roll of paper toweling. The dispenser apparatus is characterized by its relative simplicity with regard to both structure and use as compared to many prior art devices. The invention will work with both conventional paper toweling rolls having cores and coreless rolls.

Furthermore, the dispenser apparatus disclosed and claimed herein provides for the dispensing of toweling from a roll of paper toweling which does not require the consumer to contact the toweling to cause toweling advancement and unwinding of the roll.

In the subject dispenser apparatus advancement of the paper toweling is accomplished by a feed roller rotated by mechanism operated by the consumer. However, advancement of the paper toweling by the feed roller is accomplished without the paper toweling having to pass through a compressive nip.

The dispenser apparatus of the present invention also incorporates a simple, reliable approach for transferring between one towel roll upon depletion thereof to another towel roll.

The dispenser apparatus disclosed and claimed herein is for dispensing paper toweling from a roll of paper toweling. The dispenser apparatus includes a dispenser housing defining a housing interior for accommodating a roll of paper toweling therein.

A paper toweling feed roller is rotatably mounted relative to the dispenser housing having an outer peripheral roller surface for frictionally engaging paper toweling extending from a roll of paper toweling within the housing interior and for transporting the paper toweling toward a location external of the dispenser housing upon rotation of the paper toweling feed roller. Transport is due to frictional engagement between the toweling and the rotating paper toweling feed roller.

Actuator means is operatively associated with the paper toweling feed roller to rotate the paper toweling feed roller.

The dispenser apparatus also includes paper toweling guide means having a curved guide surface spaced from the paper toweling feed roller and not engaging the paper toweling feed roller. The paper toweling guide means partially surrounds the outer peripheral roller surface of the paper toweling feed roller and the curved guide surface and the outer peripheral roller surface define a curved passageway with the paper toweling feed roller through which the paper toweling passes during transport thereof by the paper toweling feed roller from the roll of paper toweling toward the location external of the dispenser housing.

The present invention also includes a method of dispensing paper toweling from a roll of paper toweling.

The method includes the step of supporting a first roll of paper toweling at a first location spaced from a rotatable paper toweling feed roller.

A paper toweling guide member having a curved guide surface is positioned at a second location spaced from the rotatable paper toweling feed roller to form a curved passageway.

The method also includes the step of placing paper toweling from a first roll of paper toweling into contact with the rotatable paper toweling feed roller in the curved passageway.

The paper toweling feed roller is rotated while the paper toweling is in contact therewith to transport the paper toweling through the curved passageway while not compressing the paper toweling.

After a segment of the paper toweling has passed through the curved passageway, the segment is separated from the remainder of the paper toweling.

Other features, advantages, and objects of the present invention will become apparent with reference to the following description and accompanying drawings.

BEST NODE FOR CARRYING OUT THE INVENTION

Figure 1:
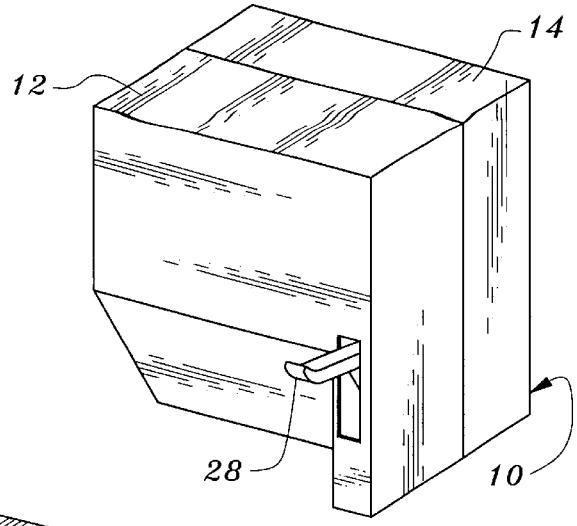
FIG. 1 is a perspective view of dispenser apparatus constructed in accordance with the teachings of the present invention with the dispenser housing thereof in closed condition.
Figure 2:
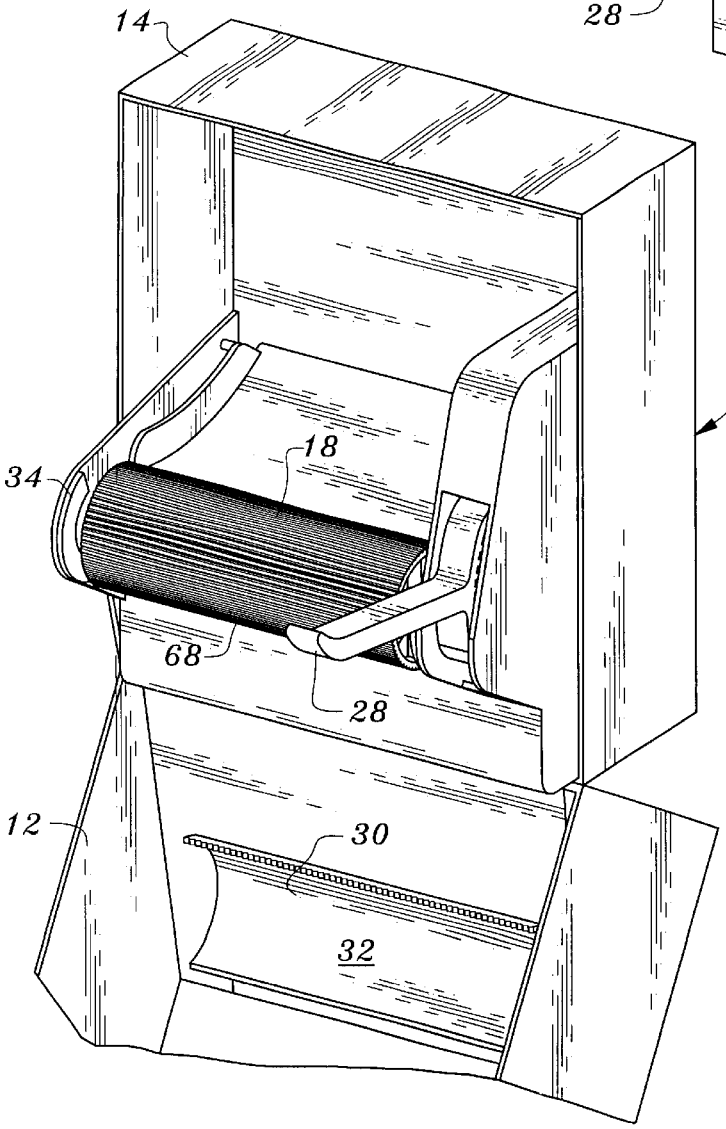
FIG. 2 is a perspective view of the apparatus, a portion thereof broken away, illustrating the housing open to disclose the interior thereof and mechanism including a feed roller and paper toweling guide.
Figure 3:
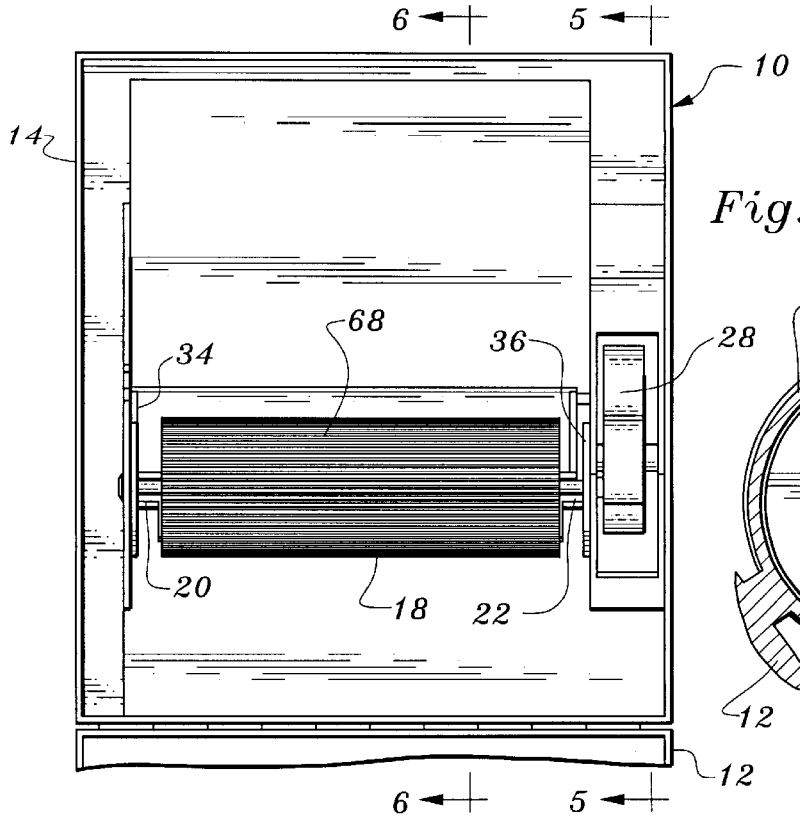
FIG. 3 is a front elevational view illustrating the dispenser housing in open condition with one of the housing portions shown in its entirety along with the paper toweling feed roller and related structure of the apparatus.
Figure 4:
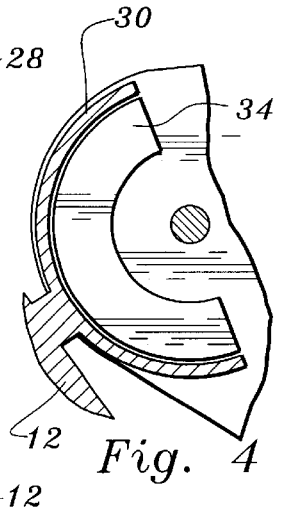
FIG. 4 is an enlarged, cross-sectional view illustrating a paper toweling guide employed in the apparatus adjacent to a stop member for maintaining a predetermined distance between the paper toweling guide and the feed roller.

Referring now to the drawings, the dispenser apparatus of the present invention includes a dispenser housing having a front housing portion or cover 12 and a rear housing portion 14. The housing portions are hingedly connected so that they can either define a closed housing configuration (shown for example in FIG. 1) or an open housing configuration (shown in FIG. 2 for example).

Mounted for rotatable movement within the interior of the dispenser housing is a paper toweling feed roller 18. Feed roller 18 includes stub shafts 20, 22 at the ends thereof which are rotatably journaled relative to the dispenser housing. In the arrangement illustrated, stub shaft 22 terminates at a pinion gear 24 engaged with the teeth of a pivotally mounted rack member 26. A lever 28 is attached to the rack member 26 and projects therefrom to a location externally of the dispenser housing.

Figure 5:
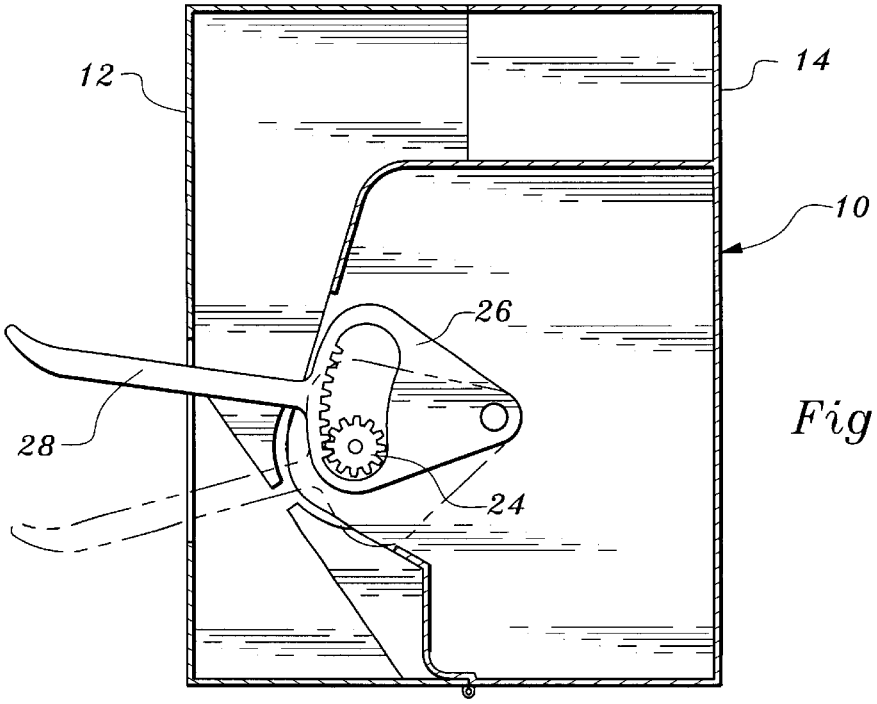
FIG. 5 is a cross-sectional view taken along the line 5—5 in FIG. 3.
Figure 6:
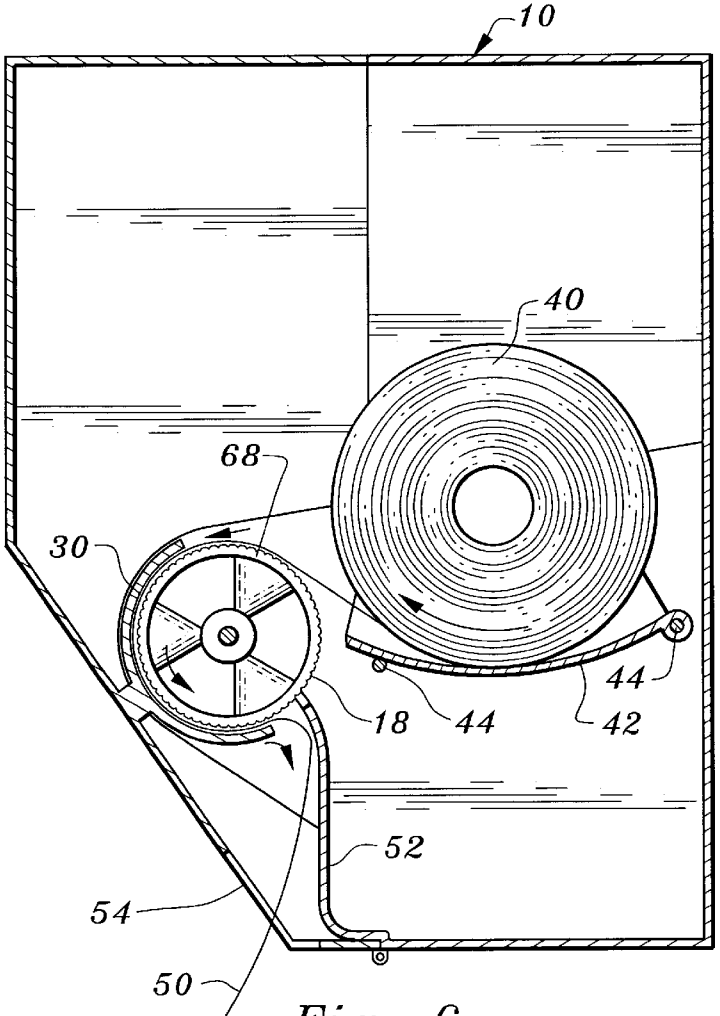
FIG. 6 is a cross-sectional view taken along the line 6—6 in FIG. 3 and illustrating unwinding of a roll of paper toweling during transport of toweling therefrom by the rotating paper toweling feed roller.
Figure 9:
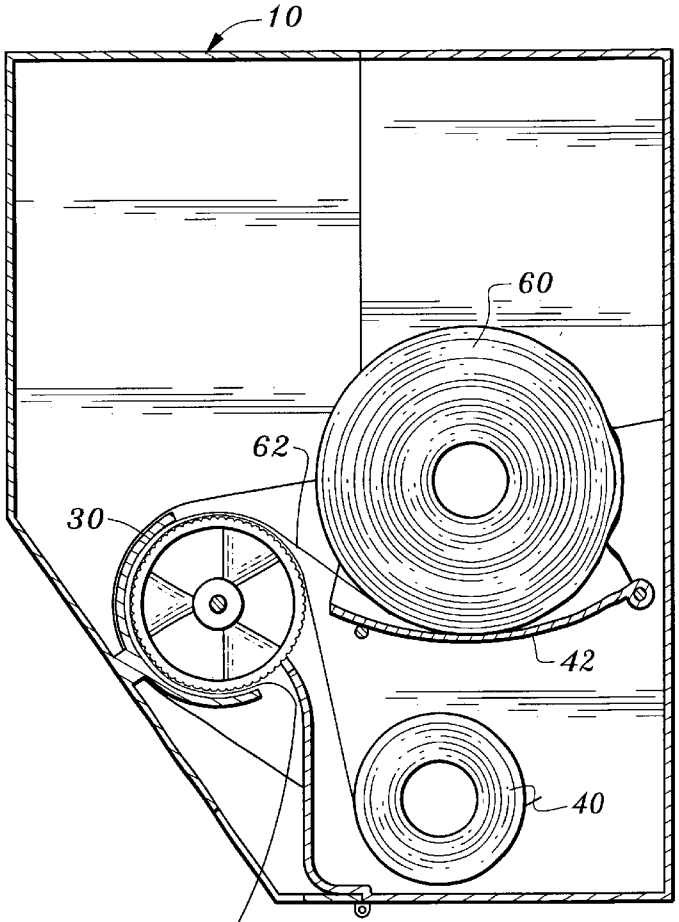
FIG. 9 is a view similar to FIG. 8, but illustrating a reserve roll of paper toweling supported over the partially depleted or primary roll.

Downward movement of lever 28 will cause pivotal movement of the rack member and rotation of pinion gear 24 and feed roller 18. The direction of rotation is counter clockwise when the feed roller and pinion gear are viewed on end from the right hand side of the dispenser housing; for example, as shown in FIGS. 5 and 6. A conventional one-way clutch mechanism (not shown) is operatively associated with the feed roller to ensure that it rotates in the desired one direction only. Since one-way clutches are well known in the paper towel feed roller art, such component has not been illustrated .

Attached to cover 12 and projecting into the interior of the dispenser housing is a paper toweling guide 30 in the form of a curved plate. Guide 30 has a curved guide surface 32, the guide surface having a semi-cylindrical configuration.

When the cover 12 is closed, the guide 30 partially surrounds the outer peripheral roller surface of paper toweling feed roller 18 and extends along an axis substantially parallel to the axis of rotation of the feed roller 18. The curved guide surface 32 is spaced from the paper toweling feed roller and does not engage or form a compressive nip therewith. The curved guide surface is smooth and has an axis coaxial with the axis of rotation of the feed roller 18.

To maintain proper spacing between the guide and the feed roller, a pair of arcuate stops 34, 36 are attached to rear housing portion 14, the stops extending into the housing interior. The outer curved surfaces of the stops conform to the shape of the curved guide surface 32 of the paper toweling guide and abutment therebetween will result in uniform proper positioning of the guide relative to the feed roller whenever the dispenser housing or cabinet is closed.

The paper toweling guide 30 and the paper toweling feed roller 18 define a curved passageway through which paper toweling passes during transport thereof from a roll of paper toweling within the dispenser housing toward a location external thereof. A substantially uniform spacing is maintained between the guide and feed roller and in the arrangement illustrated the curved guide surface 32 and the paper toweling feed roller are spaced apart a fixed predetermined distance exceeding the combined uncompressed thicknesses of paper toweling from two rolls of paper towels within the housing. As will be described in greater detail below, the apparatus of this invention is operable to effect automatic transfer between two rolls when one of the rolls expires.

FIG. 6 illustrates a single roll 40 of paper toweling located within the dispenser housing interior. Roll 40 is positioned on and supported by a support plate 42 having an upwardly directed, curved roll support surface. Support plate 42 is pivoted at pivot 44 so that it may be moved from the roll support position shown in FIG. 6, for example, to the position shown in FIG. 8. A projection 44 extending into the interior of the dispenser housing maintains the support plate 42 in proper roll support position.

After paper toweling roll 40 has been positioned within the dispenser housing, the lead end portion of the toweling thereof is disposed in the curved passageway between curved guide surface 32 and feed roller 18. The lead toweling end is not compressed between the paper toweling guide 30 and the feed roller. Rotation of the feed roller 18 as shown by the arrow associated therewith in FIG. 6 will cause transport of the toweling through the curved passageway due to frictional engagement between the feed roller and the toweling wrapped partially thereabout. After exiting the passageway the toweling (designated by reference numeral 50 in FIG. 6) will engage a deflection plate 52 and be directed to an outlet opening 54 formed in the housing. This places the toweling in position for manual access by a consumer. The consumer manipulates the projecting toweling segment in conventional fashion to tear or sever it from the rest of the toweling. If desired, conventional cutter teeth (not shown) may be located at the outlet opening to facilitate removal of the end-most segment.

Figure 7:
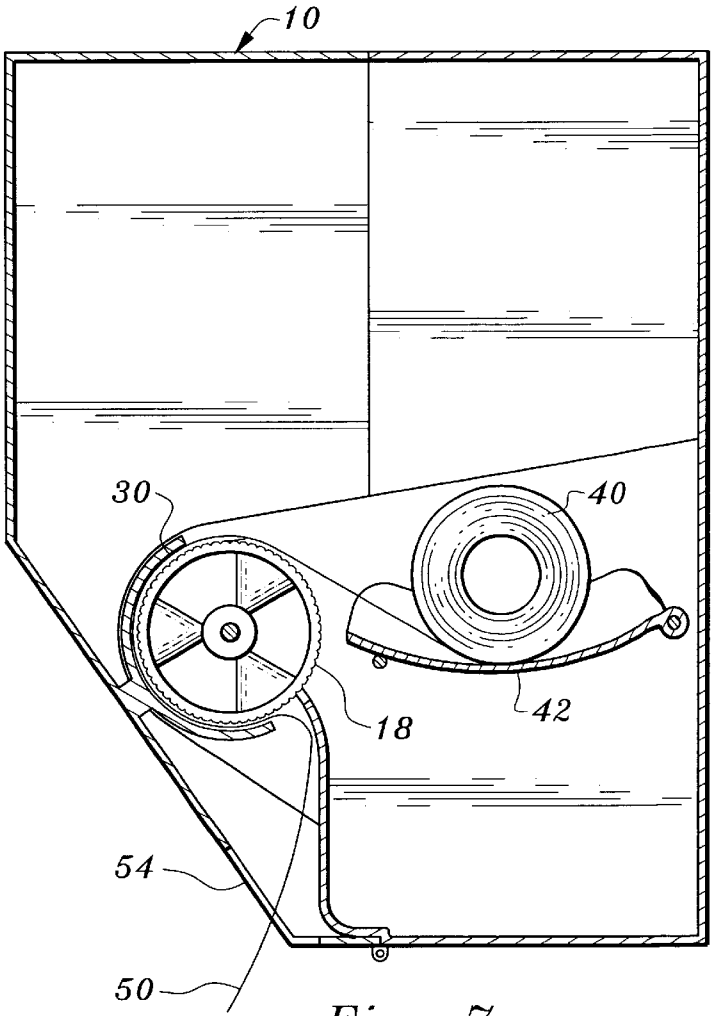
FIG. 7 is a view similar to FIG. 6, but illustrating the roll of paper toweling in a partially depleted condition.
Figure 8:
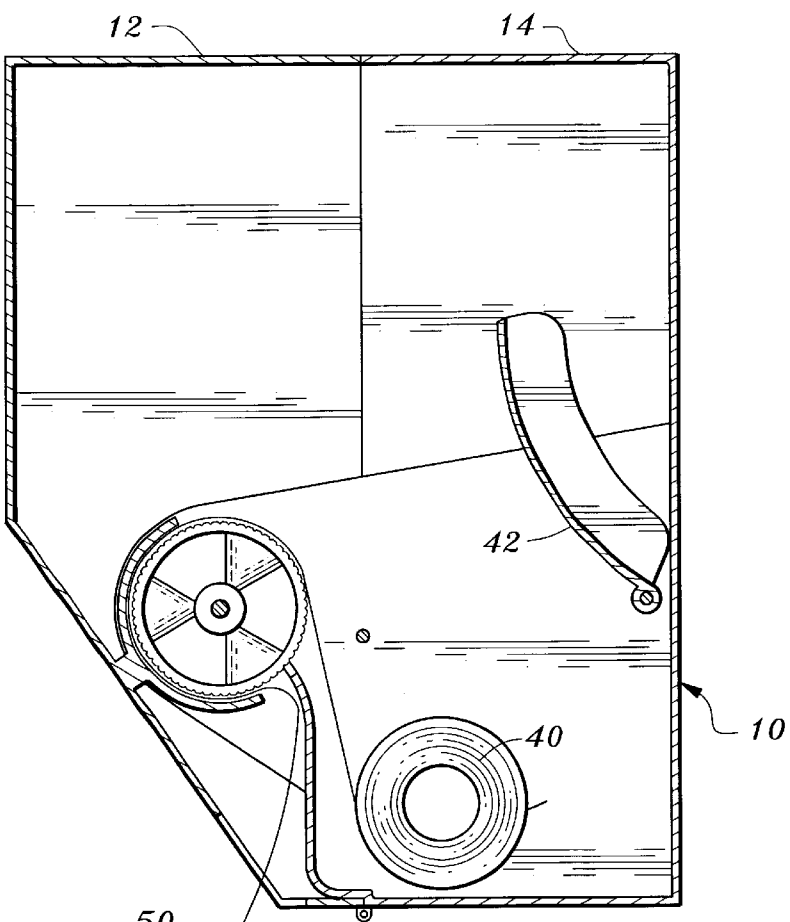
FIG. 8 is a view similar to FIG. 7, but illustrating the repositioning of the partially depleted roll of toweling within the dispenser housing interior.
Figure 11:
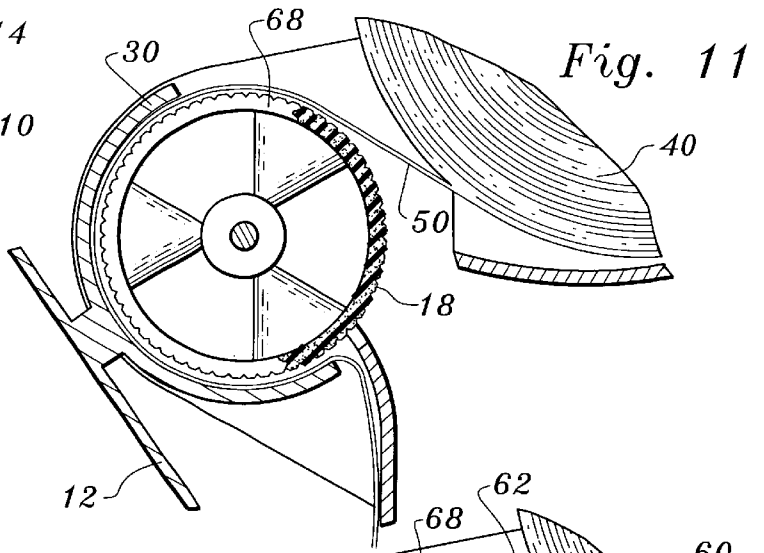
FIG. 11 is an enlarged view in partial cross-section illustrating the relationship between selected components of the apparatus and the lead end of toweling from a supported primary roll of paper toweling.

FIG. 7 shows roll 40 in a substantially depleted condition. An attendant spotting such condition will move the roll 40 to a position at the bottom of the dispenser housing. This is accomplished, as shown in FIG. 8, by temporarily swinging the support plate 42 to an elevated position and then placing roll 40 at the bottom of the housing. This enables the attendant to position a second roll 60 on the support plate 42 above roll 40. The lead end of the toweling 62 is then positioned in the curved passageway defined by the curved guide surface and the feed roller sandwiched between the paper toweling guide 30 and the toweling 50 from roll 40. Roll 60 will operate as a reserve roll from which toweling will be dispensed upon depletion of roll 40, the primary roll.

Figure 12:
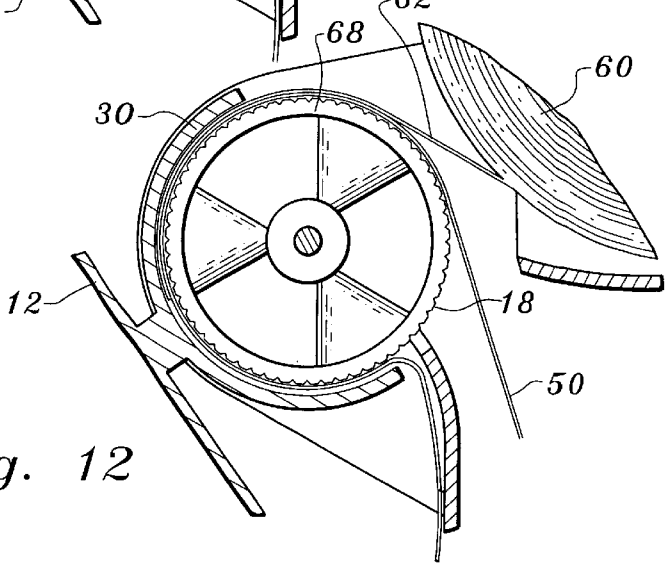
FIG. 12 is a view similar to FIG. 11, but illustrating the lead ends of toweling from both a primary and reserve roll in position in a curved passageway between the feed roller and paper toweling guide operatively associated therewith.

FIG. 12 illustrates the positioning of the lead end of toweling 62 in the curved passageway in the manner described above.

Figure 10:
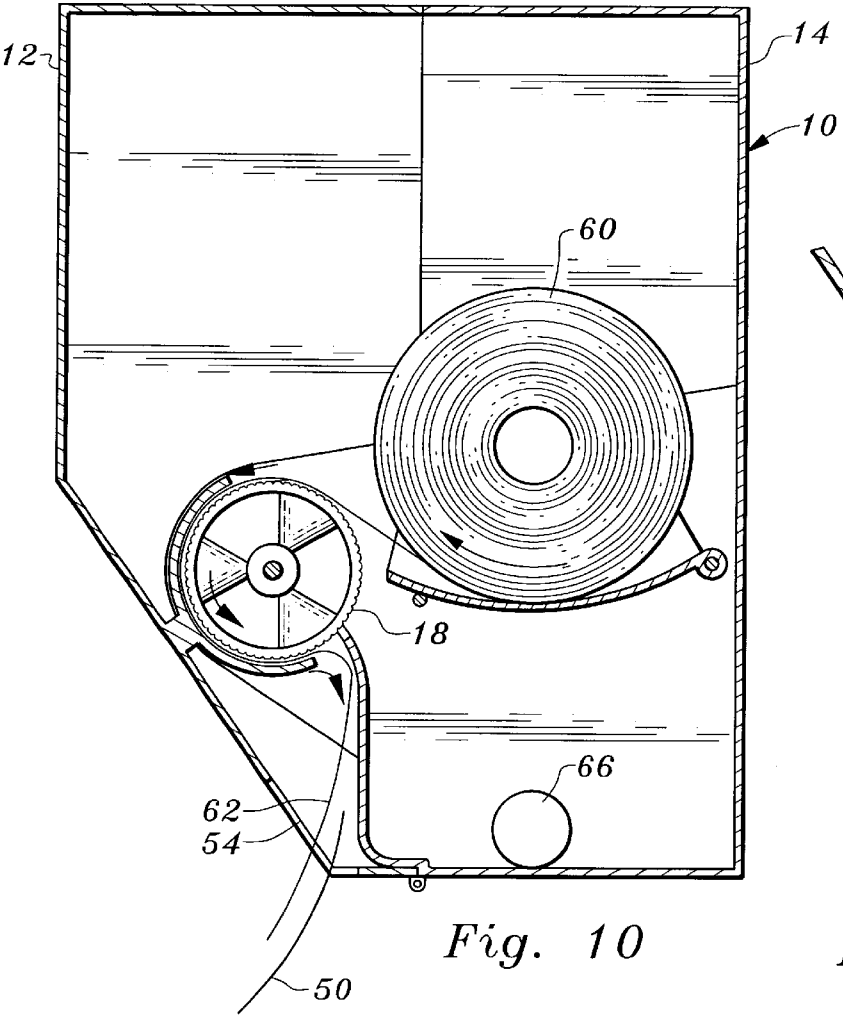
FIG. 10 is a view similar to FIG. 9, but illustrating operation of the apparatus after the primary roll has been depleted and transfer to the reserve roll has taken place.

Rotation of feed roller 18 will cause continued dispensing from roll 40 until it is depleted but will not serve to advance or transport the toweling 62 of roll 60 until toweling 50 has passed from between the lead end of toweling 62 and the feed roller. Once this occurs, the feed roller will be effective to transport the toweling 62 through the curved passageway and out through outlet opening 54 of the dispenser housing. This stage of operation is illustrated in FIG. 10 wherein only a core 66 remains from roll 40. The present invention is also suitable for use with coreless rolls of toweling.

In order to carry out the transfer operation just described, the curved guide surface and paper toweling and feed roller must be spaced apart a distance exceeding the combined thicknesses of paper toweling from both the primary roll 40 and from the reserve roll 60. Thus, the lead end of paper toweling from the reserve roll and the paper toweling from the primary roll are uncompressed by the paper toweling guide and the paper toweling feed roller.

It is also important that the static coefficient of friction between the paper toweling from the primary roll and the paper toweling feed roller exceeds the static coefficient of friction between the paper toweling from the primary roll and the paper toweling from the reserve roll. The paper toweling feed roller is thus operable to frictionally engage the paper toweling from the reserve roll and to transport the paper toweling from the reserve roll upon rotation of the paper toweling feed roller in response to transport and removal of the paper toweling from the primary roll from between the paper toweling feed roller and the paper toweling from the reserve roll.

To accomplish this end the paper toweling feed roller includes an outer roller portion 68 which is formed of soft resilient material, such as natural or synthetic rubber. In the illustrated embodiment, the outer peripheral surface of the portion 68 is not smooth. However, the outer peripheral surface possibly could be smooth. Also, the feed roller may be comprised of spaced feed roller segments rather than comprised of a continuous unitary feed roller as incorporated in the illustrated embodiment.

What is claimed is:

1. Dispenser apparatus for dispensing paper toweling from a roll of paper toweling having two opposed sides and a lead end, said dispenser apparatus comprising, in combination:

a dispenser housing defining a housing interior accommodating a roll of paper toweling therein, said paper toweling having two opposed sides and a lead end;

a paper toweling feed roller rotatably mounted relative to said dispenser housing having a cylindrically-shaped outer peripheral roller surface free of paper toweling engageable sprocket projections supporting said paper toweling and frictionally engaging one of the sides of said paper toweling adjacent to the lead end of the paper toweling with the lead end unsupported for transporting said paper toweling toward a location external of said dispenser housing without passing said paper toweling through a compressive nip and without tensioning the paper toweling between the paper toweling feed roller and the unsupported lead end of the paper toweling upon rotation of said paper toweling feed roller due solely to frictional engagement between said paper toweling feed roller and the side of said paper toweling engaged thereby, and said paper toweling feed roller comprising the sole means for transporting said paper toweling, no portion of said paper toweling feed roller extending through the paper toweling and said paper toweling feed roller operable to push the paper toweling to locate the unsupported paper toweling lead end at said location external of said dispenser housing;

actuator means operatively associated with said paper toweling feed roller to rotate said paper toweling feed roller; and a paper toweling guide having a curved, smooth guide surface fixedly spaced a predetermined distance from said paper toweling feed roller and not engaging said paper toweling feed roller, said paper toweling guide partially surrounding the cylindrically-shaped outer peripheral roller surface of said paper toweling feed roller and extending lengthwise along said cylindrically-shaped outer peripheral roller surface, and said curved, smooth guide surface and said outer peripheral roller surface defining therebetween a unobstructed curved passageway through which said paper toweling passes during transport thereof solely by said paper toweling feed roller from said roll of paper toweling toward said location external of said dispenser housing, said curved, smooth guide surface and said paper toweling feed roller being spaced apart a distance exceeding the thickness of said paper toweling whereby said paper toweling is uncompressed by said paper toweling guide and said paper toweling feed roller when passing through said curved passageway and whereby passage of said paper toweling through said curved passageway is unimpeded by said paper toweling guide, said curved, smooth guide surface of said paper toweling guide engageable with the side of the paper toweling opposed to said paper toweling feed roller without applying frictional forces thereto exceeding the frictional forces exerted on said paper toweling by said paper toweling feed roller when said paper toweling is being transported by said paper toweling feed roller to maintain the paper toweling in contact with the paper toweling feed roller.

2. The dispenser apparatus according to claim 1 wherein said curved guide surface has a generally semi-cylindrical configuration.

3. The dispenser according to claim 2 wherein said curved guide surface and said paper toweling feed roller are coaxial.

4. The dispenser apparatus according to claim 1 wherein said paper toweling feed roller includes an outer roller portion formed of soft resilient material.

5. The dispenser apparatus according to claim 1 wherein said housing interior is for accommodating both a primary roll and a reserve roll of paper toweling, said curved guide surface and said paper toweling feed roller being spaced apart a distance exceeding the combined thicknesses of paper toweling from both a primary roll and a reserve roll within said housing interior whereby a lead end of paper toweling from said reserve roll may be positioned between said curved guide surface and paper toweling from said primary roll that is in engagement with the outer peripheral roller surface of said paper toweling feed roller, with the paper toweling from both said primary roll and said reserve roll in said curved passageway being uncompressed by said paper toweling guide and said paper toweling feed roller.

6. The dispenser apparatus according to claim 5 wherein the static coefficient of friction between the paper toweling from said primary roll and said paper toweling feed roller exceeds the static coefficient of friction between the paper toweling from said primary roll and the paper toweling from said reserve roll, said paper toweling feed roller being operable to frictionally engage the paper toweling from said reserve roll and to transport the paper toweling from said reserve roll upon rotation of said paper toweling feed roller in response to and only after transport and removal of the paper toweling from said primary roll from between said paper toweling feed roller and the paper toweling from said reserve roll.

7. The dispenser apparatus according to claim 5 additionally including a roll support positioned adjacent to said paper toweling feed roller to support said reserve roll above said primary roll.

8. The dispenser apparatus according to claim 7 wherein said roll support has an upwardly directed, curved roll support surface, said roll support being pivotally connected to said dispenser housing.

9. The dispenser apparatus according to claim 8 wherein said roll support is spaced from said paper toweling feed roller to allow passage therebetween of paper toweling from said primary roll.

10. The dispenser apparatus according to claim 1 wherein said curved guide surface is generally uniformly spaced from said paper toweling feed roller.

11. The dispenser apparatus according to claim 1 wherein said paper toweling guide extends substantially parallel to the axis of rotation of said paper toweling feed roller.

12. The dispenser apparatus according to claim 11 wherein said curved guide surface extends substantially the full length of said paper toweling feed roller.

13. The dispenser apparatus according to claim 1 wherein said dispenser housing includes two relatively movable housing portions, said paper toweling feed roller being rotatably mounted on one of said portions and said paper toweling guide being mounted on the other of said portions, said housing portions being relatively movable between a first housing configuration jointly formed thereby wherein said paper toweling guide is closely adjacent to said paper toweling feed roller and a second housing configuration jointly formed thereby wherein said paper toweling guide is withdrawn from said paper toweling feed roller and not closely adjacent thereto.

14. The dispenser apparatus according to claim 13 wherein one of said housing portions comprises a dispenser cabinet body and wherein the other of said housing portions comprises a cover mounted for pivotal movement relative to said dispenser cabinet body.

15. The dispenser apparatus according to claim 13 additionally comprising stop means for engaging said paper toweling guide when said housing portions jointly form said first housing configuration to maintain a fixed predetermined distance between said paper toweling guide and said paper toweling feed roller.

16. A method of dispensing paper toweling from a roll of paper toweling, said method comprising the steps of:

supporting a first roll of paper toweling at a first location spaced from a rotatable paper toweling feed roller;

positioning a paper toweling guide member having a curved guide surface at a second location spaced from said rotatable paper toweling feed roller to form therebetween an unobstructed curved passageway;

maintaining said paper toweling guide member at said second location to maintain a fixed distance between said curved guide surface and said rotatable paper toweling feed roller, said fixed distance exceeding the thickness of said paper toweling;

placing paper toweling from said first roll of paper toweling into contact with the rotatable paper toweling feed roller in said curved passageway;

rotating said paper toweling feed roller while said paper toweling is in contact therewith to transport said paper toweling through said curved passageway while not compressing said paper toweling in said curved passageway, said paper toweling feed roller providing the sole means of transport of said paper toweling and said paper toweling not passing through a compressive nip while in contact with said rotatable paper toweling feed roller;

guiding said paper toweling with said paper toweling guide member to maintain said paper toweling partially wrapped about and in frictional engagement with said paper toweling feed roller while said paper toweling is in said curved passageway;

after a segment of said paper toweling has been transported solely by said paper toweling feed roller through said curved passageway, separating said segment from the remainder of said paper toweling;

supporting a second roll of paper at a third location spaced from said rotatable paper toweling feed roller;

positioning a leading end of paper toweling from said second roll of paper toweling into said curved passageway between the curved guide surface and the paper toweling from said first roll of paper toweling; and maintaining the paper toweling from both said first and second rolls in an uncompressed state while in said curved passageway.

17. The method according to claim 16 including the step of while maintaining the curved passageway free of obstruction, bringing the paper toweling from said second roll of paper toweling into frictional engagement with said rotatable paper toweling feed roller after rotation of said rotatable paper toweling feed roller has transported substantially all of the paper toweling from said first roll of paper toweling through said curved passageway by withdrawing the paper toweling from said first roll of paper toweling from between said rotatable paper toweling feed roller and the paper toweling from said second roll of paper toweling while the paper toweling from said second roll of toweling is immobile.

18. The method according to claim 17 including the step of rotating said rotatable paper toweling feed roller to transport the paper toweling from said second roll of paper toweling through said curved passageway due solely to frictional engagement therebetween after the paper toweling from said second roll of paper toweling has been brought into frictional engagement with said rotatable paper toweling feed roller.

19. A method of dispensing paper toweling from a roll of paper toweling, said paper toweling having two opposed sides and a lead end, said method comprising the steps of:

supporting a first roll of paper toweling at a first location spaced from the outer peripheral surface of a rotatable paper toweling feed roller, said outer peripheral surface being free of paper toweling engageable sprocket projections;

positioning a paper toweling guide member having a curved, smooth guide surface at a second location with the curved, smooth guide surface spaced a fixed distance from said rotatable paper toweling feed roller to form an unobstructed curved passageway therebetween, said fixed distance exceeding the thickness of said paper toweling;

maintaining said paper toweling guide member at said second location to maintain said fixed distance between said curved, smooth guide surface and said rotatable paper toweling feed roller;

placing one of the sides of paper toweling from said first roll of paper toweling into contact with the outer peripheral surface of the rotatable paper toweling feed roller in said curved passageway;

supporting said paper toweling on the outer peripheral surface of the rotatable paper towel feed roller at a location on said paper toweling adjacent to the lead end thereof while maintaining the lead end unsupported and free for manual grasping;

rotating said paper toweling feed roller while said paper toweling is supported thereby and one of the sides of said paper toweling is in contact therewith to transport said paper toweling through said curved passageway while not compressing said paper toweling in said curved passageway, frictional engagement between the outer peripheral surface of said paper toweling feed roller and one of the sides of the paper toweling providing the sole means of transport of said paper toweling, said paper toweling feed roller not passing through the paper toweling and said paper toweling not passing through a compressive nip while in contact with said rotatable paper toweling feed roller;

pushing the unsupported lead end of the paper toweling to a desired location during transport of said paper toweling by said paper toweling feed roller while maintaining the paper toweling free of tension between the paper toweling feed roller and the unsupported lead end of the paper toweling;

guiding said paper toweling with said paper toweling guide member to maintain one of the sides of said paper toweling partially wrapped about and in frictional engagement with the outer peripheral surface of said paper toweling feed roller while said paper toweling is in said curved passageway;

during said guiding sep, maintaining any frictional forces applied to said paper toweling by said paper toweling guide member below the level of the frictional forces applied to the paper toweling by said paper toweling feed roller whereby passage of said paper toweling through said curved passageway will not be impeded by said paper toweling guide member; and after a segment of said paper toweling has been transported solely by said paper toweling feed roller through said curved passageway and the paper toweling feed roller has pushed the paper toweling to position the unsupported lead end of the paper toweling a distance from the paper toweling feed roller and the paper toweling guide member, separating said segment from the remainder of said paper toweling.

20. The method according to claim 19 including the additional steps of supporting a second roll of paper at a third location spaced from said rotatable paper toweling feed roller, positioning a leading end of paper toweling from said second roll of paper toweling into said curved passageway between the curved guide surface and the paper toweling from said first roll of paper toweling, and maintaining the paper toweling from both said first and second rolls in an uncompressed state while in said curved passageway.

* * * * *